US005417642A

United States Patent [19]

Boronka et al.

[11] Patent Number: 5,417,642

[45] Date of Patent: May 23, 1995

[54] FOLDING JAW CYLINDER

[75] Inventors: Viktor Boronka, Münchenbuchsee; Kurt Rothen, Stettlen, both of Switzerland

[73] Assignee: Maschinfabrik Wifag, Bern, Switzerland

[21] Appl. No.: 62,412

[22] Filed: May 13, 1993

[30] Foreign Application Priority Data

May 14, 1992 [DE] Germany ..... 42 15 911.3

[51] Int. Cl.[6] ..... B65H 45/16; B41F 13/62; B41F 13/60

[52] U.S. Cl. ..... 493/425; 493/427; 493/429

[58] Field of Search ..... 493/8, 23, 424, 425, 493/426, 427, 428, 429, 471, 476

[56] References Cited

U.S. PATENT DOCUMENTS

| | | | |
|---|---|---|---|
| 2,950,105 | 8/1960 | Berry | 493/426 |
| 4,610,652 | 9/1986 | Henn et al. | 493/425 |
| 4,790,804 | 12/1988 | Gotou et al. | 493/426 |
| 5,057,064 | 10/1991 | Michalik | 493/424 |
| 5,096,175 | 3/1992 | Lange et al. | 493/426 |

FOREIGN PATENT DOCUMENTS

| | | | |
|---|---|---|---|
| 46088 | 1/1911 | Denmark | 493/425 |
| 2442949 | 3/1976 | Germany | 493/426 |
| 3220414A1 | 12/1983 | Germany | B41F 13/54 |
| 3838314A1 | 5/1990 | Germany | B41F 13/62 |
| 4035617A1 | 7/1991 | Germany | B41F 13/62 |
| 4037130A1 | 11/1991 | Germany | B41F 13/62 |

*Primary Examiner*—William E. Terrell
*Attorney, Agent, or Firm*—McGlew and Tuttle

[57] ABSTRACT

A folding jaw cylinder for a printing press has a folding jaw arranged rotatably at the cylinder, a stop for the folding jaw, a rotary body, which can be nonrotatably connected to the cylinder, and whose angular position in relation to the cylinder is adjustable, and a gear mechanism for adjusting a working distance between the folding jaw and the stop by adjusting the angular position between the cylinder and the rotary body. The stop is arranged movably at the cylinder, and is adjusted in relation to the cylinder—during the adjustment of the angular position between the cylinder and the rotary body—by an adjusting arrangement, which is articulated to the rotary body and attached to the stop.

21 Claims, 7 Drawing Sheets

FOLDING JAW CYLINDER

FIELD OF THE INVENTION

The present invention pertains to a folding jaw cylinder for a printing press in general and more particularly to a folding jaw cylinder for a printing press including a folding jaw mounted rotatably at the cylinder with a stop wherein a working distance between the folding jaw and the stop is adjustable by adjusting an angular position between the cylinder and a rotary body nonrotatably connected to the cylinder.

BACKGROUND OF THE INVENTION

To fold newspapers, magazines, brochures, and the like, the sheets to be folded or the layers of sheets to be folded, which lie one on top of another, are passed through between a pair of cylinders, consisting of a folding blade cylinder and a folding jaw cylinder, in a folding apparatus. Such a folding jaw cylinder has one or more folding jaws, which extend in the longitudinal direction of the cylinder and form a folding jaw gap, into which a folding blade arranged at the folding jaw cylinder penetrates, with a stop extending in parallel to them. The layers of printed product, mostly layers of paper, which are located at this point of the pair of cylinders, are now pressed into the gap at the folding jaw cylinder. The folding blade is subsequently withdrawn, and the folding jaw gap is closed to the extent that the printed product layers, now folded, are held firmly and are carried during the revolution of the folding jaw cylinder. Via a clamp mechanism, consisting mostly of a cam and a cam roller rolling on it, the gap width between the folding jaw and the stop is controlled such that the printed product layers can be pressed by the folding blade into the gap and clamped between the folding jaw and the stop after withdrawal of the folding blade. Besides this rhythmic changing of the gap width, a so-called working distance can be set between the folding jaws and the actually associated stops for adjustment to different numbers or thicknesses of printed product layers.

A device for adjusting this working distance during the operation of the machine has been known from DE 38 38 314 A1. The folding jaw cylinder has two hollow cylinders here, which are rotatably mounted around a common axis. A folding jaw, extending in the axial direction, is arranged on the circumference of one of the hollow cylinders, and a counterjaw, acting as a stop and facing the folding jaw, is arranged at the other hollow cylinder. The folding jaw is mounted rotatably for rhythmically adjusting the gap width and consequently for gripping the paper, while the counterjaw is attached rigidly. To adjust the working distance between the folding jaw and the counterjaw, the two hollow cylinders are pivotable against each other on a common cylinder shaft. To achieve this, the two hollow cylinders are rotated symmetrically in relation to one another via a gear mechanism, so that the respective folding jaws and counterjaws move toward or away from one another in the manner of tongs. It is to be ensured by the simultaneous and symmetrical adjustment of both hollow cylinders that the folding jaws and their respective counterjaws are arranged symmetrically to the advancing folding blades. The gear mechanism for adjusting the two hollow cylinders has an adjusting shaft, which is guided by the hollow cylinder shaft, and whose rotary movement is deflected by 90° each via two bevel gear sets and transmitted to an adjusting spindle, which has left-handed threads at one end zone and right-handed threads at the other end zone. Each threaded section is connected to one of the two hollow cylinders, so that the two hollow cylinders can be pivoted symmetrically in relation to one another by rotating the adjusting spindle, and the distance between the folding jaws and counterjaws can be adjusted as a result. The working distance is adjusted in this prior-art device as a junction of a continuous current measurement of the thickness of the printed product to be folded. Such a thickness-measuring device and the associated control devices are complicated and expensive. Furthermore, such a continuous adjustment of the working distance includes continuous regulation even in the case of thickness deviations that are within the permissible tolerance range. However, the continuous readjustments lead to a continually changing contact pressure in the area of the effective contact pressure between the folding jaw and the stop, as a consequence of which loss of printed copies or damage to printed copies may arise.

Another device for adjusting the working distance between the folding jaws and counterjaws of a folding jaw cylinder has been known from DE 40 37 130 A1. The folding jaw cylinder is likewise composed for this purpose of two hollow cylinders, at which the respective folding jaws and counterjaws are arranged in the known manner. The symmetrical, tong-like rotary movement of the two hollow cylinders takes place via complex gear mechanisms in this case.

A folding jaw cylinder likewise with two hollow cylinders, which can be rotated symmetrically and in a tong-like manner in relation to one another, at which the folding jaws are arranged rotatably and the counterjaws, rigidly, was disclosed in DE 40 35 617 A1. The device used in this prior-art folding jaw cylinder to adjust the working distance between the folding jaws and the respective counterjaws contains a sliding block, which can be displaced radially in relation to the cylinder axis. The two grooves of the sliding block extend in the shape of a V in relation to one another. A pin is rigidly attached to one of the hollow cylinders and is guided in the two grooves. The two hollow cylinders are rotated symmetrically to one another and, as a result, the working distance between the folding jaws and counterjaws is changed by the displacement of the sliding block in the radial direction toward or away from the cylinder axis.

The disadvantage of this prior-art folding jaw cylinders is the complicated design with two hollow cylinders, which must be manufactured separately and subsequently assembled. The mechanism known from DE 38 38 314 A1 for the mutual adjustment of the two hollow cylinders with adjusting shafts extending through the hollow cylinders, with bevel gear sets for deflecting the rotary movements and with the adjusting spindle is complicated, expensive, and susceptible to malfunction. Reliable self-locking of the adjusting spindle cannot be guaranteed. The gear mechanism arranged within the hollow cylinders according to DE 32 20 414 A1 is also complicated and expensive because of the multiple gear deflections. Problems arise in the solution according to DE 40 35 617 because of the contact pressure acting on the sliding block in the grooves. Such an adjustment inherently leads to clearance in a relatively short time, so that accurate adjustment of the working distance between the folding jaws and counterjaws is no longer guaranteed. In addition, the cleaning of such adjusting mechanisms, arranged in the hollow cylinder, requires complete disassembly of the cylinder in the case of contamination as a consequence of the oil and paper dust escaping massively in the folding apparatus. Contaminations represent a particular problem because of the risk of jamming, which may easily occur in these adjusting mechanisms because of the complex design with long operating chains, i.e., with multiple deflections, transmissions, sliding blocks, etc.

A one-part folding jaw cylinder is disclosed in DE 32 20 4 14 A1. The folding jaw and the movable counterjaw can be adjusted here to the paper thickness to be processed. The counterjaw is displaceable via two eccentric bolts approximately in the circumferential direction of the folding jaw cylinder and as a result, it can be adjusted to a defined value in relation to the folding blade. The folding jaw, controlled via a cam roller, is fastened with screws to a spindle, which is mounted on both sides in the cylinder body of the folding jaw cylinder. To adjust the working distance between the folding jaw and the counterjaw, not only is the counterjaw displaced, but the folding jaw is also rotated in relation to the cylinder. The connection between the folding jaw and the cam roller must be interrupted for this purpose, and the part of the connection carrying the folding jaw must be made rotatable and lockable via another system of eccentric bolts in relation to the part carrying the cam roller. Adjustment of the working distance is possible only when the press has stopped, and it requires the adjustment of the eccentric bolts of the folding jaws and counterjaws one by one. An adjusting mechanism for coordinating the adjusting movements of the counterjaw and the folding jaw is not provided.

SUMMARY AND OBJECTS OF THE INVENTION

The primary object of the present invention is to avoid the disadvantages occurring in connection with the adjustment of the working distance between a folding jaw and a counterjaw acting as a stop in the folding jaw cylinders known from the state of the art. In particular, the adjustment of the working distance shall be performed in a coordinated manner via an adjusting mechanism. The adjusting mechanism and the folding jaw cylinder shall have a simple design. The adjusting mechanism shall be insensitive to contamination and guarantee reliable self-locking during the operation of the folding jaw cylinder.

The invention provides a folding jaw cylinder for a printing press with a folding jaw mounted rotatably on the cylinder. A stop for the folding jaw is provided with a stop arranged movably at the cylinder. A rotary body is provided non-rotatably connected to the cylinder. Angular position means is provided for adjusting an angular position of the rotary body in relation to the cylinder. An adjusting means is provided which is articulated to the rotary body and attached to the stop. During an angular position adjustment between the cylinder and the rotary body, the adjusts means for adjusting the stop in relation to the cylinder.

According to the present invention, a folding jaw cylinder is a cylinder, at which both a folding jaw and a stop, preferably in the form of a stop plate, are arranged. A rotary body rotating around the same axis can be nonrotatably connected to the cylinder, so that the cylinder and the rotary body can be rotated in terms of their angular positions in relation to one another and can be subsequently connected nonrotatably to one another, or they are continuously connected to one another by a corresponding coupling mechanism during this relative angular position adjustment. The movement of the stop arranged at the cylinder is coupled, according to the present invention, with the angular position adjustment between the cylinder and the rotary body, namely, by an adjusting means, which is articulated to the rotary body and is attached to the stop. The attachment to the stop may be, in principle, rigid, although it is preferably a hinged attachment. If the cylinder has a plurality of pairs of folding jaws and stops, one adjusting means is associated with each stop. The folding jaw cylinder according to the present invention may consequently be of a one-part design, which offers the advantage of simpler and less expensive manufacture and installation compared with a multipart cylinder with hollow cylinders inserted into one another. Each angular position adjustment between the cylinder and the rotary body is also coupled by the one or more adjusting means with an adjustment of the stop or stops in relation to the cylinder and consequently in relation to the folding jaw or jaws, so that a rotation of the folding jaw cylinder in relation to a corresponding folding blade cylinder can be compensated by a forced countermovement of the stop or stops. In summary, the advantage of the present invention is based on the fact that the folding jaw cylinder is of a one-part design and the working distance between the folding jaw and the stop can nevertheless be adjusted solely by adjusting the angular position of the cylinder in relation to a rotary body.

Since the entire mechanism needed for the coordinated adjustment of the working distance is advantageously arranged outside the folding jaw cylinder, the installation and especially the repairs or maintenance work that may subsequently become necessary are substantially facilitated because of the inherently easy accessibility.

Such a stop may be arranged displaceably at the folding jaw cylinder; however, it is advantageously rotatable around an axis arranged in parallel and eccentrically to the axis of rotation of the cylinder. The associated folding jaw is particularly advantageously mounted at the cylinder rotatably around the same axis.

In order for a folding blade to come always centrally between a folding jaw/stop pair during the rotation of the folding jaw cylinder in relation to the folding blade cylinder, the countermovement of the stop, which is necessary for compensation of the rotation of the cylinder, can take place via a spur gear mechanism, consisting of a central spur gear forming the rotary body and of an external gear, which is arranged planetarily in relation to the said spur gear and engages it. In this embodiment of the present invention, the external gear is nonrotatably connected to the rotatably mounted stop due to being attached to, e.g., the axis of rotation of the stop. Each stop is thus connected to such an external gear.

In a preferred embodiment of the present invention, the adjusting means is formed by a lever, which is articulated to the rotary body by means of a pivot beating. In the case of a rotatably mounted stop, such a lever is also preferably articulated to the stop by means of a pivot bearing, while it is preferably rigidly attached to the stop in the case of a displaceably arranged stop. To ensure that the folding blade always plunges centrally into the gap formed between the pair of folding jaws, the rotation of the folding jaw cylinder in relation to the folding blade cylinder is compensated by a corresponding counterrotation of the stop around its own axis of rotation in the first embodiment.

Such a lever is particularly preferably designed as a rigid connection between its coupling to the rotary body and that to the stop. The lever may be suitably bent or kinked or is designed as a simple, straight bar.

The rotary body preferably has the shape of a disk or star with a number of arms corresponding to the number of pairs of folding jaws and stops. Such a lever system comprising the rotary body and one or more levers shows hardly any signs of wear, which could lead to a play in the adjustment of the working distance between the individual pairs of folding jaws and stops, even after prolonged operating time. Contamination problems can hardly occur any more. The design of the adjusting means according to the present invention as a lever consequently represents a particularly heavy-duty, simple and therefore inexpensive solution for the coordinated adjustment of the working distance.

The angular position adjustment of the folding jaw cylinder may be performed manually or automatically, and advantageously both manually and automatically via a corresponding actuating drive. According to a simple embodiment of the present invention, the manual adjustment is performed via a spindle drive with a spindle, which rotates in a spindle nut mounted rotatably at the rotary body and in a spindle holder rigidly connected to the cylinder. The spindle nut is rotatable around an axis that is parallel to the cylinder axis. The spindle has two threaded sections of different pitch, of which the threaded section of the smaller pitch rotates in the spindle holder at the cylinder. Free rotation of the spindle can be prevented by a compression spring arranged concentrically to the spindle between the holder and the spindle nut or by other suitable play-limiting elements. The adjustment of the spindle is performed, with the folding jaw cylinder stopped, preferably manually via a vernier, but would, in principle, also be able to be performed by means of a motor operator rotating the spindle.

In another preferred embodiment of the present invention, the adjustment of the working distance may also be performed with the folding jaw cylinder rotating. The angular position adjustment is performed by an adjusting gear mechanism with two gears, which are arranged in series, are preferably displaceable along their common axis of rotation in relation to one another, and are nonrotatably connected to one another. One of these gears engages a mating gear attached to the folding jaw cylinder, and the other engages a mating gear attached to the rotary body. The gear of the adjusting gear mechanism coupled with the rotary body is preferably the driven gear. The gear of the adjusting gear mechanism coupled with the folding jaw cylinder is a helical gear, so that axial displacement of this gear brings about rotation of the mating gear, which is also a helical gear in this case, and consequently a rotation of the folding jaw cylinder. The displacement of the gear of the adjusting gear mechanism coupled with the folding jaw cylinder takes place via a spindle drive, which is operated either manually or especially advantageously automatically via a motor operator. The two possibilities of operation may also coexist.

According to a particularly preferred embodiment of the present invention, the adjustment of the working distance is performed via a motor operator control as a function of adjustable actuating variables, especially the number of pages of the printed product, and possibly the weight of the paper per unit area, by which the working distance to be adjusted is determined.

Based on the printed product to be finished, it is possible to store the necessary production factors in a memory of a computer-controlled printing press. Standards of a great variety of printed products, especially of newspapers, such as newspaper format, paper grade, type of production, etc., possibly supplemented by current dam, can thus be recorded once and reused for fully automatic production control.

In addition, tables on text volume, which define the number of pages of individual newspaper editions, are recorded. Corresponding to the text volume, the number of pages and, from the number of pages together with the known paper thickness, the thickness of the printed product to be folded are determined. The limited number of possible values for the number of pages and the values for the paper weight per unit area, which are divided into paper weight groups, are advantageously stored discretely in the form of a list or a common table. At an entry station, e.g., a press control station, the values for a defined printed product can be selected from the stored lists and preset. Since it is known from, e.g., newsprint making that the specific volume, defined as the ratio of the paper thickness to the basis weight, shall be 1.45 $cm^3/g$, an unambiguous assignment of the basis weight and the corresponding paper thickness is always obtained. The set value for the working distance can thus be determined for a single or double production as the sum of a correction factor for the paper roughness and the product of the paper thickness calculated and the number of pages of the printed product.

The paper thickness, which also affects the folding process, can be stored in the memory of such a machine control in the form of a chart and included in the calculation of the set values for the working distance. The working distance can thus be preset fully automatically with very high accuracy, without requiring continuous measurement of the thickness of the printed product to be folded, which would lead to continuous readjustments.

Such an automatic adjustment is facilitated especially by the adjustment of the working distance according to the present invention, which is performed by the angular position adjustment alone. The adjustment of the working distance in a folding jaw cylinder according to the present invention can consequently be performed, in principle, fully automatically beginning from the entry, or also manually, either with the press stopped or running.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
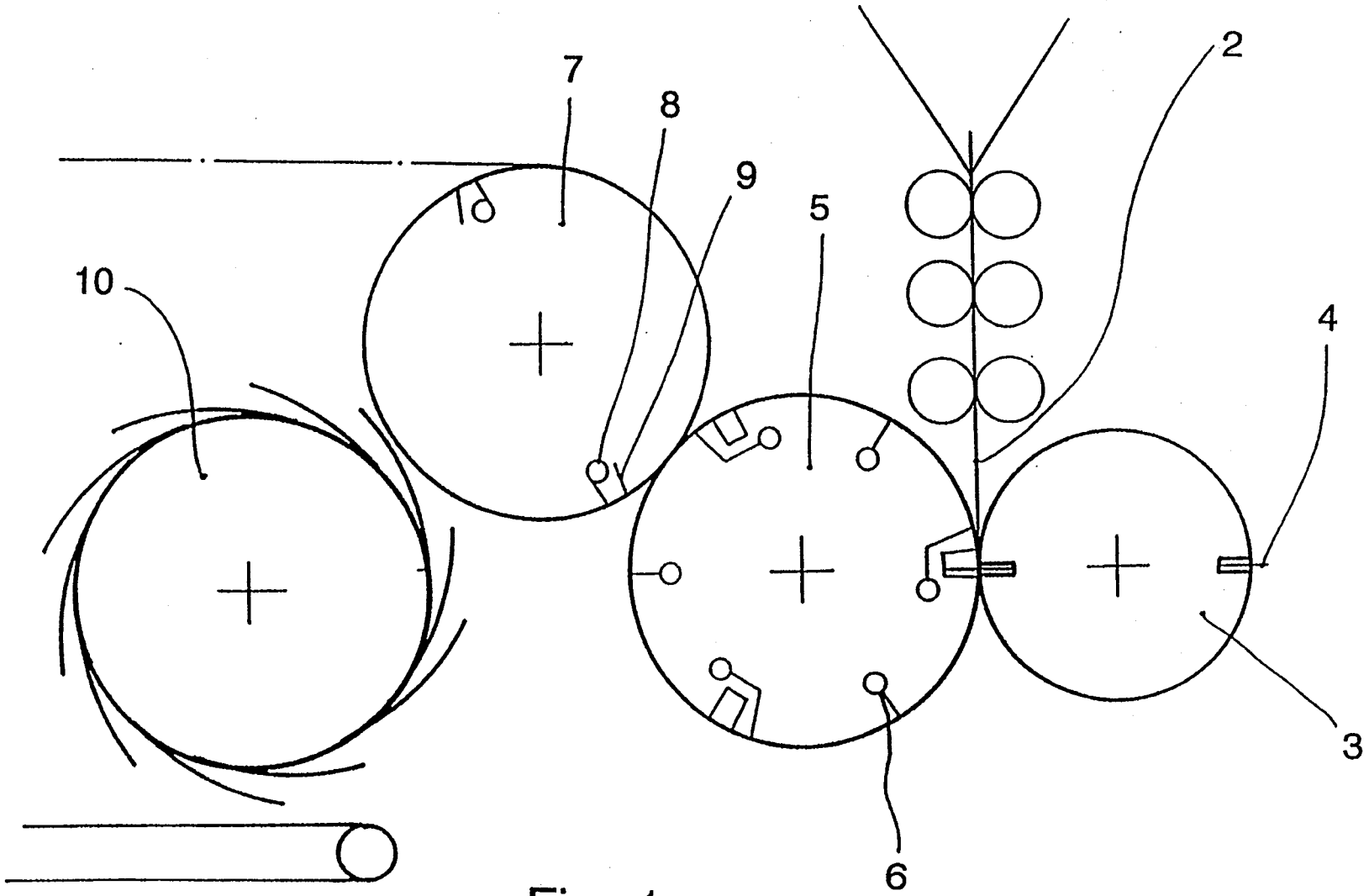
FIG. 1 is a schematic representation of the essential components of a folding apparatus.

The essential parts of a folding apparatus are shown in FIG. 1. A printing web 2 is passed through between a cutting blade cylinder 3 and a folding blade cylinder 5 and is cut to the desired length by means of a cutting blade 4. The cut printed product 2, which may be a multilayer product, subsequently runs, carried by the folding blade cylinder 5, through the gap between the folding blade cylinder 5 and a folding jaw cylinder 7. The cut printed product is folded in the process, and removed as a finished printed product 2 via a bucket wheel delivery means 10.

Figure 2:
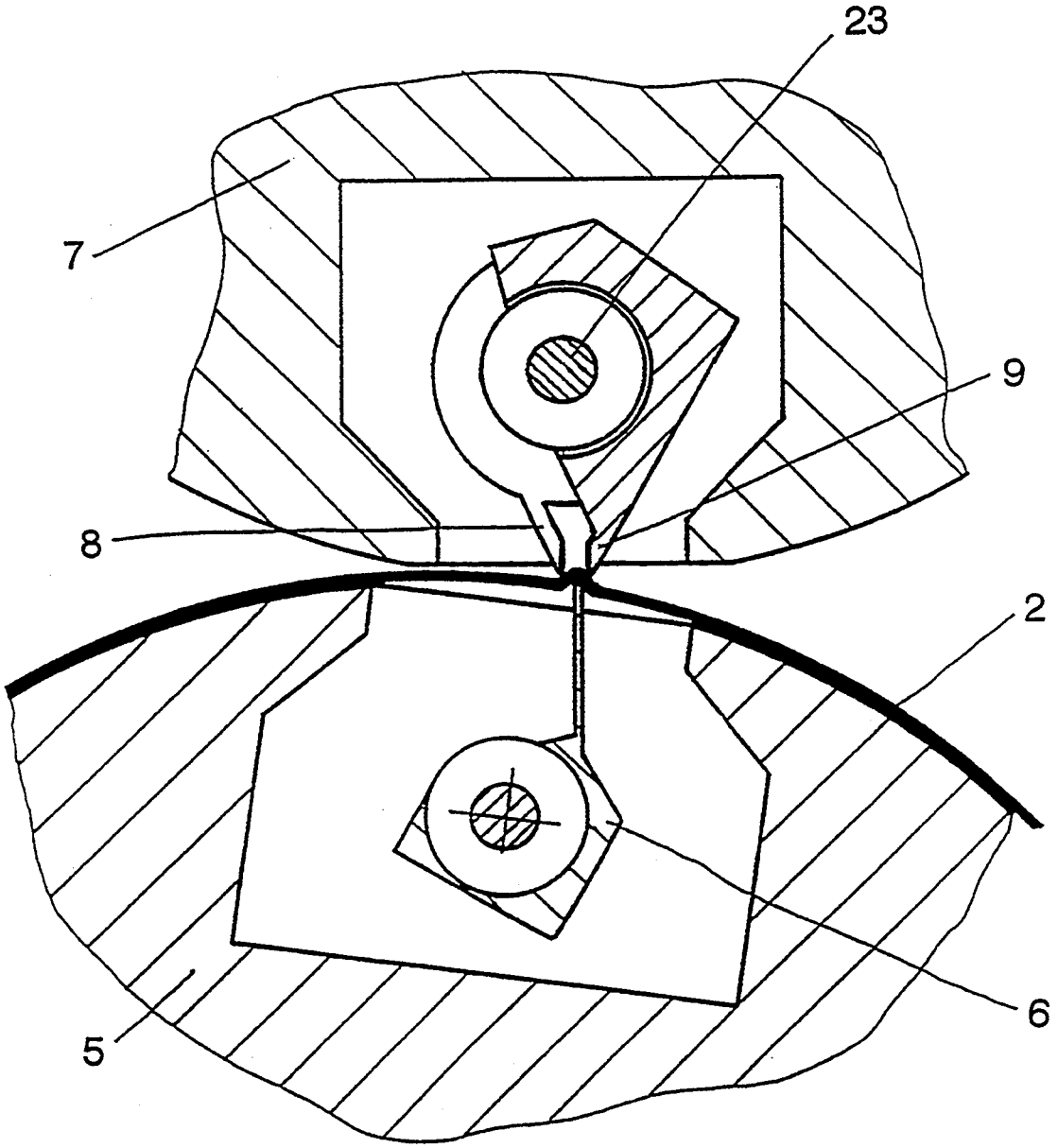
FIG. 2 is an enlarged sectional view showing a folding process.

During the folding process shown in FIG. 2, the multilayer printed product 2 is pressed by means of a folding blade 6 into a gap formed between a folding jaw 8 and a stop 9. After withdrawal of the folding blade 6, the folding jaw 8 is rotated around its axis of rotation 23 against the said stop 9. This rotation of the said folding jaw 8 may be controlled via a clamping means such as a cam in the known manner.

Figure 3A:
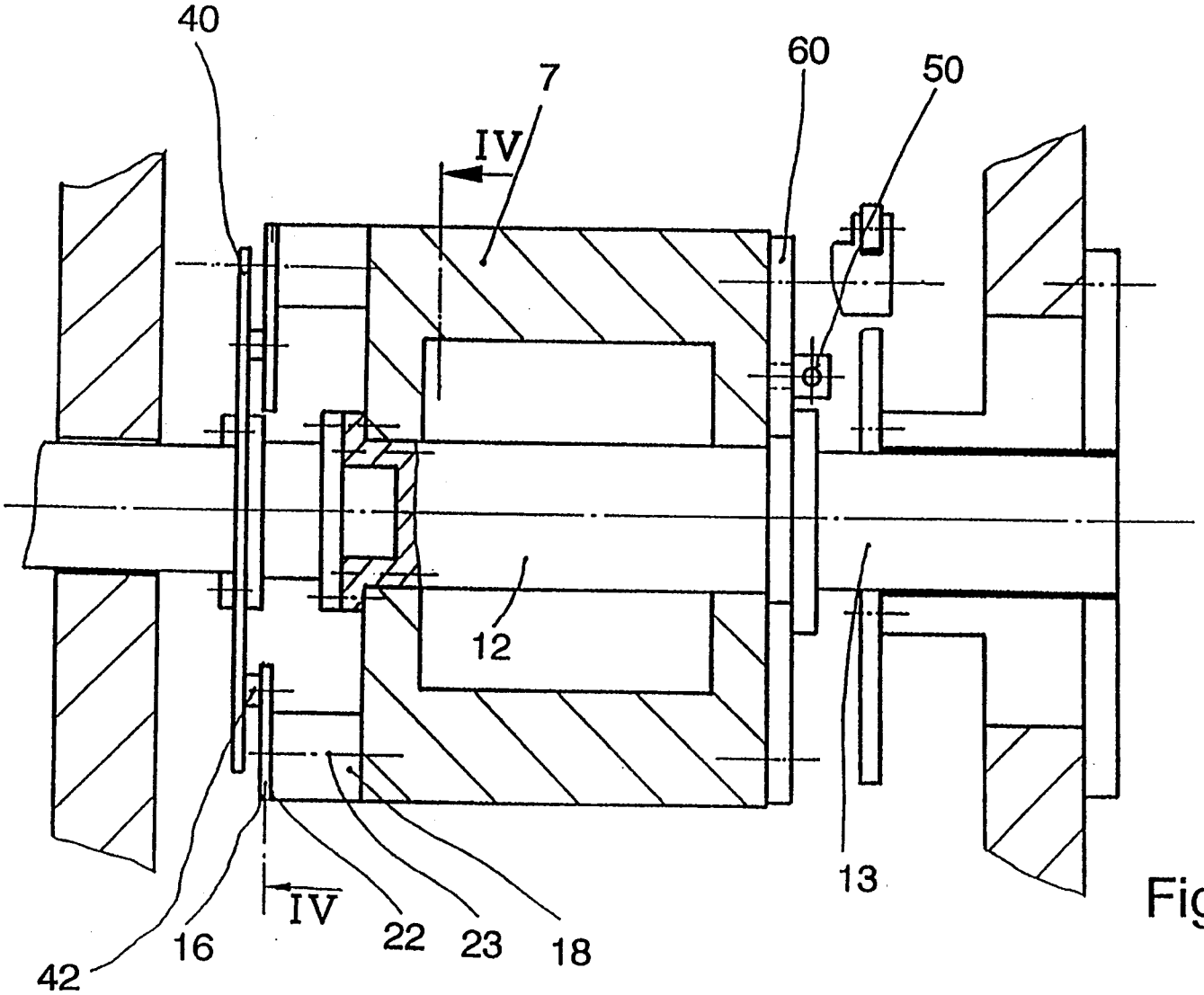
FIG. 3*a* is a sectional representation of a folding jaw cylinder that is coupled with a rotary body via a lever system according to the invention.

FIG. 3*a* shows a folding jaw cylinder 7 with an adjusting spindle 50 arranged at its front side and a rotary body 40 arranged at its other front side. The folding jaw cylinder 7 is mounted rotatably on a driven shaft 12, to which the rotary body 40 and a cross-shaped support 60 are each connected rigidly. The rotary movement of the shaft 12 is again rigidly coupled with the rotary movement of the folding jaw cylinder 7 via the non-positive connection to the cross-shaped support 60. Four folding jaw spindles 18 are arranged uniformly distributed on the circumference of the folding jaw cylinder 7 in this exemplary embodiment.

Figure 4:
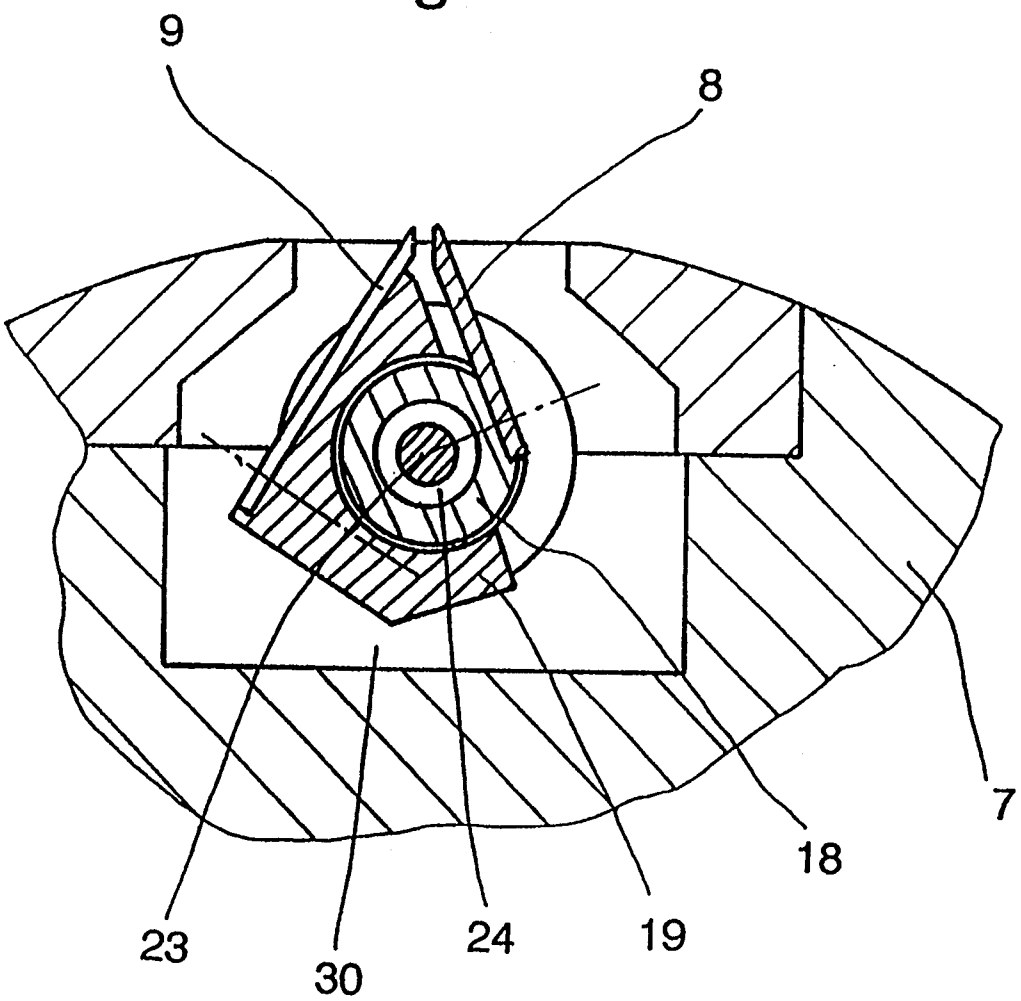
FIG. 4 is a sectional view IV—IV according to FIGS. 3*a* and 3*b* of a folding jaw/stop pair rotatable around a common axis according to the invention.

FIG. 4 shows the cross section A—A of a folding jaw spindle 18. The folding jaw spindle 18 and a support tube 19 are accommodated in a recess 30 of the folding jaw cylinder 7. The folding jaw spindle 18 with a folding jaw 8 and the support tube 19 with a stop 9 designed as a stop plate are rotatable around the common axis 23.

The working distance is adjusted by rotary movement of the folding jaw cylinder 7 in relation to the folding blade cylinder 5 (see FIG. 1 for comparison), to which a corresponding countermovement of the stop plate is superimposed such that the protruding folding blade 6 is at an equally spaced location from the free end of the folding jaw 8 and the free end of the stop plate 9. The superimposition or coupling of these rotary movements taking place in opposite directions is achieved by an adjusting means, as is shown in FIG. 3*a*, via levers 16, which are each articulated to the rotary body 40 and the support tube 19. The linkage 22 to the support tube 19 and the linkage 42 to the rotary body 40 are designed as pivot bearings in this exemplary embodiment.

Figure 5:
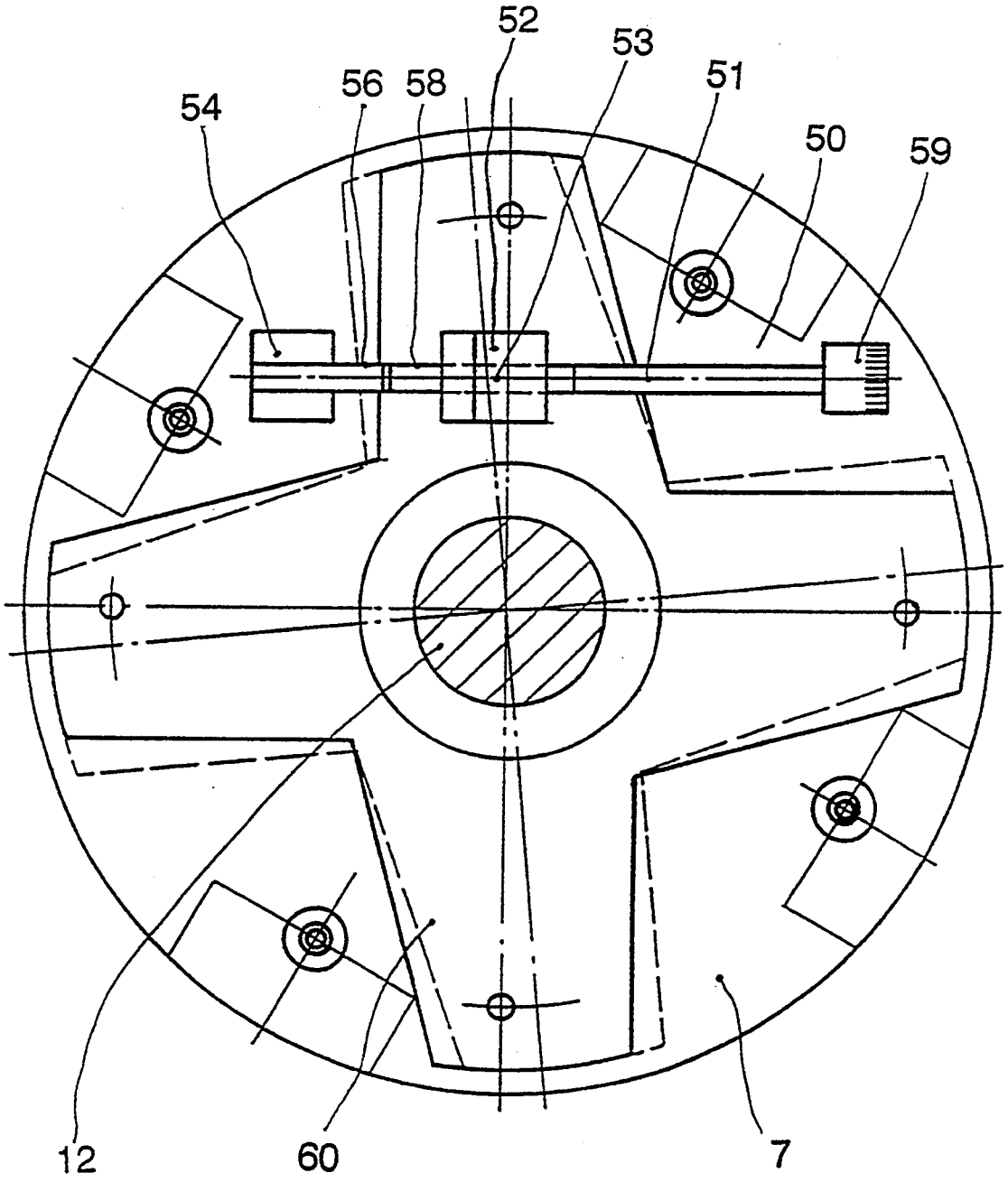
FIG. 5 is a partially sectional view showing the folding jaw cylinder according to FIG. 3*a* with an adjusting spindle for adjusting the angular position of the folding jaw cylinder in relation to the rotary body according to the invention.

One form of an angular position means is an adjusting spindle 50 is used in the exemplary embodiment according to FIG. 3*a* to adjust the angular position of the folding jaw cylinder 7 in relation to the rotary body 40. The mode of operation of the adjusting spindle 50 is recognizable from FIG. 5. A spindle 51 has two threaded sections of different pitch, of which the threaded section of the greater pitch runs in a spindle nut 52, which is mounted rotatably around an axis 53 extending in parallel to the shaft 12 on a cross-shaped support 60 connected nonrotatably to the shaft 12. The outer, second threaded section of the lower pitch rotates in a spindle holder 54 attached rigidly to the folding jaw cylinder 7. The spindle 51 is adjusted manually via a vernier 59 or via an adjusting motor, which is, e.g., a battery-operated adjusting motor and is arranged on the front side at the adjusting spindle. Instead of or in addition hereto, it would also be possible to operate the adjusting spindle 50 via a manually controllable or press computer-controlled motor operator. A compression spring 56 clamped between the spindle nut 52 and the spindle holder 54 prevents play of the adjusting spindle 50. A bellows 58 ensures that the threads of the spindle 51 cannot become contaminated.

Figure 6:
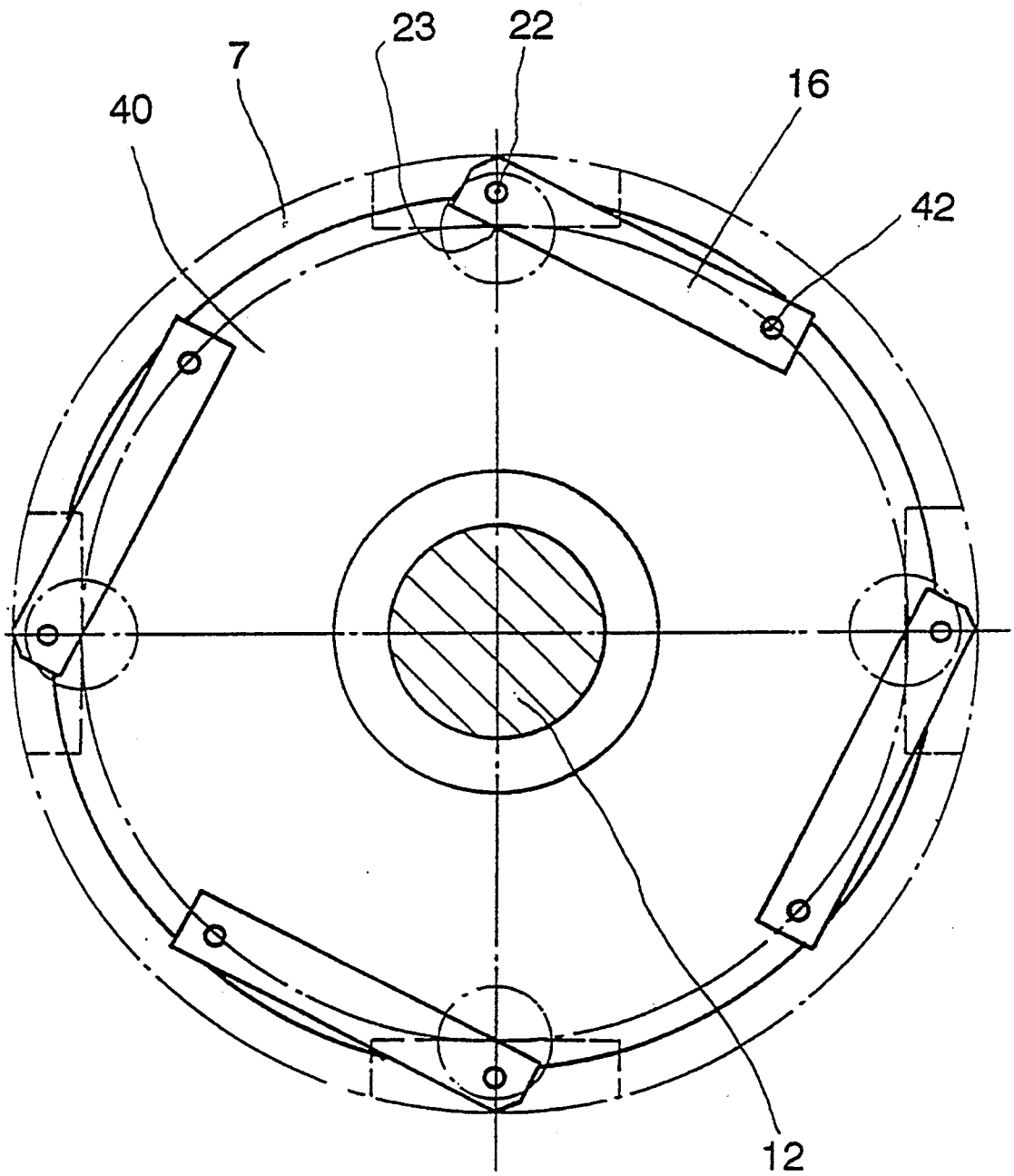
FIG. 6 is a folding jaw cylinder according to FIGS. 3*a* and 3*b* with levers articulated to the rotary body and to the stops of the folding jaw cylinder according to the invention.

FIG. 6 shows the levers 16 articulated stationarily to the rotary body 40 via their respective pivot bearings 42. These represent four pairs of folding jaws 8 and stop plates 9 according to FIG. 4, which pairs are arranged offset by 90° each around a folding jaw cylinder 7. A lever 16, designed as a rigid, straight bar, is articulated to each support tube 19 by means of the pivot bearing 22 at a spaced location from the axis of rotation 23 of the support tube 19. Each lever 16 is articulated with its other end to the rotary body 40 in a pivot bearing 42, and the pivot bearings 42 are arranged uniformly distributed on a circle on the rotary body 40. A rotation in the opposite direction of the stop plates 9 attached to the support tubes 19 is brought about by the levers 16 with the rotation of the folding jaw cylinder 7 in relation to the rotary body 40. The dimensioning of the length of the levers and the linkages 22 to the support tubes 19 and the linkages 42 to the rotary body 40 are performed such that the free ends of the stop plates 9 are moved back by a travel section against the direction of rotation of the folding jaw cylinder 7 that is twice the travel section of the free ends of the folding jaws 8 during the angular position adjustment of the folding jaw cylinder 7. As a result, it is ensured that the folding blades 6 penetrate exactly in relation to the axis of rotation 12 in the middle of the folding jaw gap between the tips of the folding jaws 8 and the stop plates 9 after each relative angular position adjustment of the said folding jaw cylinder 7.

Figure 3B:
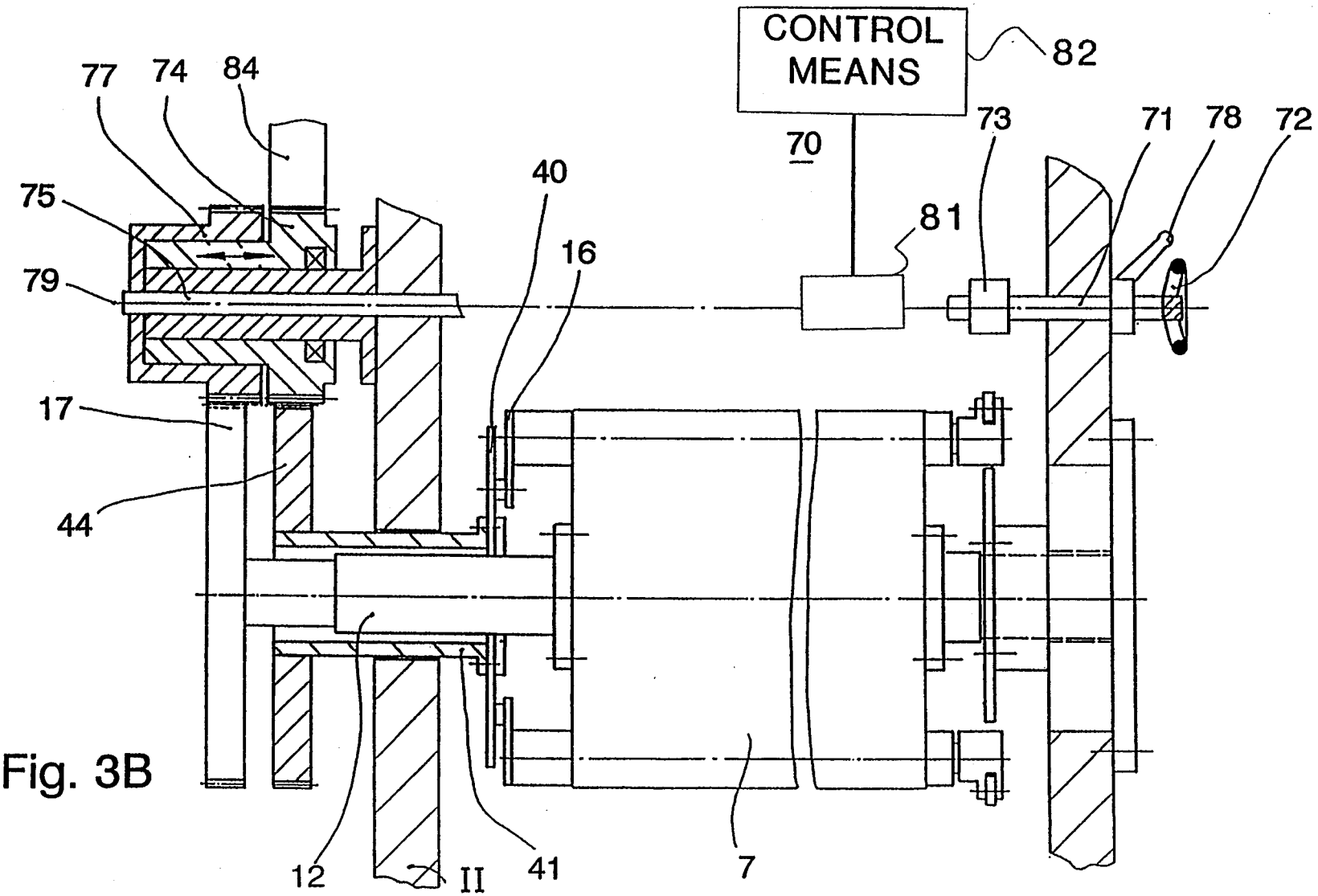
FIG. 3*b* is a sectional representation of a folding jaw cylinder for the rotation of the rotary body and of the folding jaw cylinder in opposite directions according to the invention.

While the adjustment of the working distance between the folding jaws 8 and the corresponding stop plates 9 is performed only with the press stopped in the exemplary embodiment according to FIG. 3*a*, adjustment is also possible during rotation in the case of the folding jaw cylinder 7 shown in FIG. 3*b*. The folding jaw cylinder 7 is rigidly connected to the shaft 12 here, while the rotary body 40 is mounted on a cylinder bushing 41 mounted rotatably on the shaft 12. The cylinder bushing 41 is mounted rotatably in the stationary frame II. The system of the levers 16 may correspond to that of the preceding exemplary embodiment. Another embodiment of the angular position means includes a cylinder gear 17 and a rotary part gear 44, which are torsionally rigidly connected to the shaft 12 and the cylinder bushing 41 respectively, and are mounted on the shaft 12 and the cylinder bushing 41. The helical gear 17 mounted on the shaft 12 engages a corresponding cylinder helical mating gear 77 of an adjusting gear mechanism 70, and the gear 44 mounted on the cylinder bushing 41 engages a drive gear 74 of the same adjusting gear mechanism 70. The drive gear 74 of the adjusting gear mechanism 70 is driven via a gear 84 of the cylinder drive and in turn it acts itself as a driven gear 74 to the folding jaw cylinder 7. The helical gear 77 of the adjusting gear mechanism 70 is nonrotatably connected to its driven gear 74, but the two gears 74 and 77 are also able to be displaced toward one another in parallel to the common axis of rotation 79. The helical gear 77 in this exemplary embodiment is therefore connected to a central, first adjusting rod part 75, which is displaceable along the common axis of rotation 79 of the two gears 74 and 77. The parallel displacement of the first adjusting rod part 75 and consequently of the gear 77 is performed by rotating a handwheel 72 via a second adjusting rod part 71, which is separated from the first adjusting rod part 75 at a transition point 73 and can be locked via a clamping lever 78. The rotary movement of the handwheel 72 is converted into a longitudinal movement of the first adjusting rod part 75 and consequently of the gear 77 via a sliding movement of the second adjusting rod part 71 at the transition point 73. Since the two engaging gears 17 and 77 of the folding jaw cylinder 7 and of the adjusting gear mechanism 70 are helical gears, the angular position of the folding jaw cylinder 7 is adjusted in relation to the cylinder bushing 41 during this displacement of the gear 77, and it is consequently adjusted in relation to the rotary body 40. The superimposed adjustment of the stop plates 9 in the opposite direction is performed via the levers 16 described. The handwheel 72 may be complemented or replaced by a motor means 81 controlled by a control means 82 press computer in order to make possible the fully automatic adjustment of the working distance between the folding jaws 8 and the stop plates 9.

While specific embodiments of the invention have been shown and described in detail to illustrate the application of the principles of the invention, it will be understood that the invention may be embodied otherwise without departing from such principles.

What is claimed is:

1. A folding apparatus for a printing press, the apparatus comprising:

a folding cylinder rotatably mounted in the press;

a folding jaw positioned on said folding cylinder;

a stop positioned on said folding cylinder for cooperating with said folding jaw to grip a fold, said stop having structure for being pivotally mounted on said folding cylinder about a jaw axis substantially parallel and eccentric to an axis of rotation of said folding cylinder;

clamping means for moving said folding jaw toward and away from said stop to grip and release a fold, said clamping means moves said folding jaw with respect to said folding cylinder to move said folding jaw toward and away from said stop, said clamping means moving said folding jaw at specific angular positions of said folding cylinder with respect to the printing press;

a rotary body rotatably connected to said folding cylinder;

adjusting means for adjusting a working distance between said folding jaw and said stop depending on an angular position of said rotary body with respect to said folding cylinder, said adjusting means moves said stop toward and away from said folding jaw with respect to said cylinder to adjust said working distance, said working distance being a distance between said folding jaw and said stop when said clamping means is not gripping a fold;

angular position means for varying an angular position of said rotary body with respect to said folding cylinder.

2. An apparatus in accordance with claim 1, wherein:

said folding jaw also has structure for being pivotally mounted on said folding cylinder about said jaw axis.

3. An apparatus in accordance with claim 1, wherein:

said adjusting means includes a lever connected to said rotary body in an articulated connection, said lever also being connected to said stop, said lever being rigid and rod shaped.

4. An apparatus in accordance with claim 3, wherein:

said lever is connected to said stop by a first pivot bearing;

said lever is connected to said rotary part by a second pivot bearing.

5. An apparatus in accordance with claim 1, wherein:

said adjusting means includes a gear rigidly attached to said stop and engaging with a gear connected to said rotary body.

6. An apparatus in accordance with claim 1, wherein:

said rotary body is positioned at an axial end of said folding cylinder.

7. An apparatus in accordance with claim 1, further comprising:

another folding jaw positioned on said folding cylinder;

another stop positioned on said folding cylinder;

another adjusting means for adjusting a working distance between said another folding jaw and said another stop depending on said angular position of said rotary body with respect to said folding cylinder, each of said adjusting means and said another adjusting means being articulated to said rotary part.

8. An apparatus in accordance with claim 1, wherein:

said angular position means includes a shaft fixed to said rotary part and rotatable with respect to said folding cylinder, said angular position means also includes a spindle holder mounted on said folding cylinder, a spindle nut connected to said shaft and said spindle is rotatably mounted in said spindle holder and said spindle nut, said spindle nut being pivotal about an axis substantially parallel to an axis of said shaft.

9. An apparatus in accordance with claim 8, wherein:

said spindle has a first threaded section rotating in said spindle nut and a second threaded section rotating in said spindle holder, said second threaded section having a lower pitch than said first threaded section.

10. An apparatus in accordance with claim 8, wherein:

said angular position means includes a manual rotating means for manually rotating said spindle.

11. An apparatus in accordance with claim 8, wherein:

said angular position means includes a servo motor means for automatically rotating said spindle.

12. An apparatus in accordance with claim 1, wherein:

said angular position means includes a cylinder gear connected to said folding cylinder and a cylinder helical gear mating with said cylinder gear, said cylinder helical gear being displaceable with respect to said cylinder gear for varying said angular position of said rotary body with respect to said folding cylinder.

13. An apparatus in accordance with claim 12, wherein:

said angular position means includes a rotary part gear connected to said rotary part and a drive gear mating with said rotary part gear.

14. An apparatus in accordance with claim 13, wherein:

said drive gear and said helical gear are rotationally fixed to each other.

15. An apparatus in accordance with claim 14, wherein:

said helical gear is axially displaceable with respect to said drive gear.

16. An apparatus in accordance with claim 15, wherein:

said angular displacement means includes a spindle drive means for axially displacing said helical gear with respect to said drive gear, said spindle means including a manual rotating means for manually rotating said spindle means.

17. An apparatus in accordance with claim 15, wherein:

said angular displacement means includes a spindle drive means for axially displacing said helical gear with respect to said drive gear, said spindle means including a servo motor means for automatically rotating said spindle means.

18. An apparatus in accordance with claim 1, further comprising:

control means for receiving a number of layers to be folded and for controlling said angular position means to cause said working distance to change to a magnitude to receive the number of layers to be folded.

19. An apparatus in accordance with claim 18, wherein:

said control means also receives a weight of the number of layers to be folded and adjusts said working distance accordingly.

20. An apparatus in accordance with claim 18, wherein:

said control means also receives a roughness of the number of layers to be folded and adjusts said working distance accordingly.

21. A folding apparatus for a printing press, the apparatus comprising:

a folding cylinder;

a folding jaw positioned on said folding cylinder;

a stop positioned on said folding cylinder;

clamping means for moving said folding jaw toward and away from said stop to grip and release a fold, said clamping means moves said folding jaw with respect to said folding cylinder to move said folding jaw toward and away from said stop, said clamping means moving said folding jaw at specific angular positions of said folding cylinder with respect to the printing press;

a rotary body rotatably connected to said folding cylinder;

adjusting means for adjusting a working distance between said folding jaw and said stop depending on an angular position of said rotary body with respect to said folding cylinder, said adjusting means moves said stop toward and away from said folding jaw with respect to said cylinder to adjust said working distance, said working distance being a distance between said folding jaw and said stop when said clamping means is not gripping a fold;

angular position means for varying an angular position of said rotary body with respect to said folding cylinder.

* * * * *